US009790007B2

(12) United States Patent
Sorensen et al.

(10) Patent No.: US 9,790,007 B2
(45) Date of Patent: Oct. 17, 2017

(54) LID FOR A CONTAINER

(71) Applicant: RUNWAY BLUE, LLC, Lehi, UT (US)

(72) Inventors: Steven M. Sorensen, Alpine, UT (US); David O. Meyers, East Layton, UT (US)

(73) Assignee: RUNWAY BLUE, LLC, Lehi, UT (US)

( * ) Notice: Subject to any disclaimer, the term of this patent is extended or adjusted under 35 U.S.C. 154(b) by 17 days.

(21) Appl. No.: 14/951,405

(22) Filed: Nov. 24, 2015

(65) Prior Publication Data

US 2017/0144809 A1 May 25, 2017

(51) Int. Cl.

| | |
|---|---|
| ***B65D 47/06*** | (2006.01) |
| ***B65D 43/02*** | (2006.01) |
| ***B65D 43/16*** | (2006.01) |
| ***B65D 43/22*** | (2006.01) |
| ***B65D 43/26*** | (2006.01) |

(52) U.S. Cl.

CPC ..... *B65D 47/065* (2013.01); *B65D 43/02* (2013.01); *B65D 43/16* (2013.01); *B65D 43/22* (2013.01); *B65D 43/26* (2013.01)

(58) Field of Classification Search

CPC ..... B65D 47/065; B65D 43/02; B65D 43/26; B65D 43/22; B65D 43/16

USPC ... 220/254.1, 254.3, 259.1, 703, 705, 254.4, 220/254.6, 818, 707, 708, 709, 711, 212; 215/229, 387, 388

See application file for complete search history.

(56) References Cited

U.S. PATENT DOCUMENTS

| | | | | |
|---|---|---|---|---|
| D653,081 | S | 1/2012 | George | |
| 8,622,237 | B2 * | 1/2014 | Choi | A47G 19/2266 215/11.4 |
| D700,014 | S | 2/2014 | Zeanah | |
| D720,184 | S | 12/2014 | Gilbert | |
| D729,569 | S | 5/2015 | Herbst | |
| D742,230 | S | 11/2015 | Charles | |
| D745,827 | S | 12/2015 | Sorensen et al. | |
| D747,136 | S | 1/2016 | Lane | |
| D748,430 | S | 2/2016 | Sorensen et al. | |
| D756,702 | S | 5/2016 | Joseph | |
| D768,491 | S | 10/2016 | Sorensen | |
| 2002/0040909 | A1 * | 4/2002 | Goto | A47G 19/2266 220/709 |

(Continued)

OTHER PUBLICATIONS

Office Action from U.S. Appl. No. 29/546,708 dated Nov. 9, 2016.

(Continued)

*Primary Examiner* — Robert J Hicks
*Assistant Examiner* — Kareen Thomas
(74) *Attorney, Agent, or Firm* — Maschoff Brennan

(57) ABSTRACT

A lid may be sized and configured to be attached to a container, and the lid may include an activator, a fluid-flow member, and a connecting member. The activator, the fluid-flow member and the connecting member may be pivotally connected. The activator, the fluid-flow member, and the connecting member may be movable between open and closed positions. When the activator, the fluid-flow member, and the connecting member are in the closed position, fluid may be prevented from exiting the container. When the activator, the fluid-flow member, and the connecting member are in the open position, fluid may exit the container through a fluid passageway.

22 Claims, 11 Drawing Sheets

(56) References Cited

U.S. PATENT DOCUMENTS

| | | | | |
|---|---|---|---|---|
| 2004/0069783 | A1* | 4/2004 | Chen | A47G 19/2266 220/254.3 |
| 2006/0226110 | A1 | 10/2006 | Choi | |
| 2008/0277020 | A1* | 11/2008 | Windmiller | B65D 1/06 141/113 |
| 2010/0181329 | A1 | 7/2010 | Davies | |
| 2011/0253733 | A1 | 10/2011 | Meyers | |
| 2012/0181277 | A1* | 7/2012 | Wang-Wu | B65D 47/305 220/212 |
| 2012/0234789 | A1* | 9/2012 | Mason | B65D 77/28 215/229 |
| 2012/0305559 | A1* | 12/2012 | Steininger | B65D 47/065 220/253 |
| 2014/0263476 | A1 | 9/2014 | Blain et al. | |
| 2014/0319183 | A1 | 10/2014 | Choi et al. | |
| 2015/0173539 | A1 | 6/2015 | Mason | |
| 2015/0201773 | A1 | 7/2015 | Sorensen et al. | |
| 2015/0201774 | A1 | 7/2015 | Sorensen et al. | |
| 2015/0201775 | A1 | 7/2015 | Sorensen et al. | |
| 2015/0210443 | A1 | 7/2015 | Sarson | |

OTHER PUBLICATIONS

U.S. Appl. No. 29/546,708, filed Nov. 24, 2015, Sorensen, et al.
International Search Report and Written Opinion dated Mar. 27, 2017 as received in Application No. PCT/ US2016/063346, 18 pgs.

* cited by examiner

LID FOR A CONTAINER

BACKGROUND

Field of the Invention

The present invention generally relates to containers and lids and, in particular, to a lid for container.

Description of Related Art

Conventional containers may hold a variety of different types of liquids and fluids. For instance, known containers may hold water, beverages, liquid refreshments, sodas, juices, thirst-quenchers, and the like.

Containers may be used in a wide variety of environments such as at home, office, gym or health club, and while traveling. Containers may also be used during activities such as exercising, driving a car, or riding in an automobile, bus, train, or airplane. In addition, containers may be used in other situations and environments such as at work, at job sites, and while performing various tasks and trades.

Many known containers include a body or vessel for holding a fluid and a lid to prevent the fluid from spilling. There are a number of known types of closures to prevent fluid from spilling such as internally threaded bottle caps, externally threaded screw caps or tops, stoppers, toggle or swing-type closures, crown caps, flip-tops, and friction or interference fit lids.

Often times it is desirable for the lid to create a fluid-tight seal to prevent the contents of the container from leaking. Some conventional lids that are fluid-tight, however, are difficult or inconvenient to use. In addition, many known lids may include grooves or crevices in which particles or materials may get stuck or caught in during use. Further, some known lids may be difficult to use or clean because of the shape, number of parts, complex configuration, and interconnection of the components.

In some instances, conventional containers may hold fluids that require mixing. For example, conventional containers may hold powdered drinks, electrolyte pills, energy drinks, baby formulas, pancake batters, crepe mixes, baking materials, dietary supplements, salsa, sauces, oil and vinegar, salad dressings, smoothies, and the like. These types of containers that hold fluids for mixing may require the lid to be securely closed and the lid to be fluid-tight so that fluid does not leak from the lid.

Some known containers that are designed to mix ingredients by shaking the container may include lids that are difficult and time consuming to open and close. For example, the lid may be screwed on the container and the user may have to unscrew the lid to dispense the contents, which may be especially difficult for users with limited agility or dexterity. Some known containers may not be leak-proof and the contents may leak when shaking the container or if the container is placed at an angle.

Furthermore, some users may want to take a drink from a container in environments such as while exercising, working, gardening, playing games or sports, hiking, climbing, commuting, and the like. In these situations, a user may want to quickly and immediately drink from the container. In addition, in some environments, the user may be wearing gloves. Many convention lids, however, are inconvenient or awkward to use in such situations.

BRIEF SUMMARY OF THE INVENTION

A need therefore exists for an apparatus or device that eliminates the above-described disadvantages and problems.

One aspect is a lid for a container that may be used with a wide variety of liquids and fluids such as water, soda, liquid refreshments, etc. In particular, the container could hold one or more liquids, beverages, drinks, juices, vitamin-enhanced beverages, energy drinks, thirst-quenchers, flavored waters, and the like. Additionally, the container could hold various powders, mixtures, and/or solutions, which could include vitamins, supplements, powdered drinks, electrolyte pills, protein powders, medicinal products, baby formulas, etc. If desired, the container could also hold solids and/or other types of materials including foodstuffs such as fruits, vegetables, soups, dressings, sauces, batters, baking materials, and the like. The container could further hold non-edible fluids, which could include paint, household cleaners, etc.

Another aspect is a lid for a container that may allow the contents to be stirred, shaken, mixed, and/or blended as desired. This may allow protein drinks, shakes, smoothies, meal replacements, dressings, sauces, etc. to be created and/or stored within the container. Advantageously, the lid and container may be reusable and refillable, which may allow the lid and container to be used for many different purposes over an extended period of time. The lid and container may also be easily carried and portable. For example, the lid and/or container may be conveniently held in one-hand by the user. If desired, the lid and/or container may be insulated to help keep the contents at a desired temperature, such as at a lower or higher temperature. Further, the lid and/or container may include a small number of parts and components, which may facilitate manufacturing and assembly. The small number of parts and components may also facilitate cleaning and may make the lid and container easier to use.

Still another aspect is a lid that may be quickly and easily coupled to a container. If desired, the lid may be easily attached and/or detached from the container, which may allow the lid and container to be easily cleaned. The lid may also allow the container to be easily filled from various sources. Advantageously, the lid may be connected to containers of different types, sizes, shapes, and configurations, depending, for example, upon the intended use of the container. The lid and container may be used or sold in combination, or the lid and/or container may be individually or independently used and/or sold.

Yet another aspect is a lid that may be constructed from plastic. For example, the lid may be constructed from injection molded plastic. The lid, however, may also be constructed from other suitable processes such as compression molding, blow molding, rotational molding, thermoforming, and the like. It will also be appreciated that the lid may be constructed from other materials with suitable characteristics and properties such as metals, composites, and the like. Advantageously, the lid may be attached to containers made from plastic, glass, metal, and the like.

Still yet another aspect is a lid that may be constructed from relatively few parts, which may allow the lid to be quickly and efficiently manufactured. The lid may also include one or more parts or components that are integrally formed as part of a unitary, one-piece structure. In an exemplary embodiment, the lid may include a lower portion that is sized and configured to be connected to the container, and the lower portion may include one or more threads that allow the lid to be connected to a container. The lid may be selectively attachable and removable from the container, if desired. The lid may also be attached to the container with a fluid or water-tight seal, which may help prevent the contents from leaking or spilling. Further, the lid may cover a relatively large mouth or opening to allow the container to be easily filled, cleaned, and washed. While the lid may be selectively attached to the container, the lid could be permanently attached to the container.

A further aspect is a lid that includes one or more of the following: an activator, a connecting member, and a fluid-flow member. The connecting member may be connected to the activator and the fluid-flow member. In particular, the connecting member may be pivotally connected to both the activator and the fluid-flow member. In an exemplary embodiment, the activator and the fluid-flow member may be pivotally connected to the lid, and the connecting member may be pivotally connected to the activator and the fluid-flow member. Advantageously, the movement of the activator may cause the connecting member and the fluid-flow member to move because of the interconnection of the activator, the connecting member and the fluid-flow member.

A still further aspect is a lid that may include a fluid pathway that allows fluid to flow from the container. For instance, the fluid pathway may be connected, aligned, disposed in, or otherwise in fluid communication with an opening or aperture in the lid. The fluid pathway may also include a flexible, elastic and/or bendable portion, which may allow the fluid pathway to bend or be disposed at an angle. In one exemplary embodiment, the fluid pathway may be bent at an angle that prevents fluid flow through the fluid pathway. The fluid pathway may further include a mouthpiece that facilitates a user drinking, sucking, or otherwise obtaining fluid from the container.

Yet another further aspect is the activator and fluid-flow member may be movable between open and closed positions. When the activator and/or flow-flow member is in the closed position, fluid may not flow through the fluid-flow member. Preferably, the activator and fluid-flow member are connected or linked together so that when the activator is in the closed position, the fluid-flow member is in the closed position and fluid cannot flow through the fluid-flow member. In addition, when the activator is in the open position, the fluid-flow member is in the open position and fluid can flow through the fluid-flow member. The connecting member may connect or link the activator and fluid-flow member so that movement of the activator moves the fluid-flow member. For instance, if the activator is moved into the open position, the fluid-flow member may be moved into the open position. On the other hand, if the activator is moved into the closed position, the fluid-flow member may be moved into the closed position.

Still yet another further aspect is the fluid pathway may be closed when the fluid-flow member, connecting member and/or activator is in a closed position. For example, when the fluid-flow member, the connecting member, and the activator are in the closed position, fluid may be prevented from exiting the container through the fluid pathway. In greater detail, when the fluid-flow member, the connecting member, and the activator are in the closed position, the connecting member may be sized and configured to pinch or otherwise close at least a portion of the fluid pathway. Alternatively, when the fluid-flow member, the connecting member, and the activator are in the open position, the connecting member may not pinch or close the fluid pathway and fluid may be able to flow through the fluid pathway.

The lid may include a body and the lid may cover or extend over at least a portion of the mouth of the container. The lid may be removable and that may allow the mouth of the container to be easily filled, cleaned, and washed. When the activator, the connecting member, and the fluid-flow member are in the closed position, the lid may be closed and no fluid may flow through the fluid pathway. This may create a sealed and/or leak-proof container. Alternatively, when the activator, the connecting member, and the fluid-flow member are in the open position, fluid may flow through the fluid pathway and a user may be able to consume the fluid.

The activator may be pivotally connected to the lid and the activator may include an extension, such as a handle, carrying member, engagement portion, and the like, that extends generally upwardly and/or outwardly from an upper surface of the activator. The extension may have a loop-shaped configuration, which may facilitate carrying of the container. A user may apply a force to the extension to open the lid. For example, an opening force on the extension may cause the activator, the connecting member, and the fluid-flow member to move into the open position. Advantageously, the user may not touch any other portion of the lid, which may facilitate use of the lid when a user's hands may be unclean or unwashed, the user is wearing gloves, the user's hands are sweaty or perspiring, and the like. A user may apply a closing force to the extension and that may cause the activator, the connecting member, and the flow-flow member to move into the closed position.

The connecting member may include an elongated body and one or more sidewalls. In some embodiments, a first sidewall may be disposed on a first side of the body and a second sidewall may be disposed on a second side of the body. The first and second sidewalls may be spaced apart by the body of the connecting member, and the first and second sidewalls may be generally parallel. The connecting member may be pivotally connected to the fluid-flow member and the activator. In greater detail, fluid-flow member and the activator may be pivotally connected to the first and second sidewalls of the connecting member. When the fluid-flow member is in the closed position, at least a portion of the fluid-flow member may be disposed between the sidewalls of the connecting member and/or may contact an upper surface of the connecting member.

The fluid-flow member may be pivotally connected to the lid and the fluid-flow member may include an aperture or opening. A portion of the fluid pathway may be disposed in, aligned with, and/or extend through the opening in the fluid-flow member. When the fluid-flow member, the connecting member, and the activator are in the closed position, the opening in the fluid-flow member may be disposed generally perpendicular to a length of the body of the connecting member. When the fluid-flow member, the connecting member, and the activator are in the closed position, an upper portion of the fluid pathway may be disposed generally parallel to the length of the body of the connecting member. When the fluid-flow member, the connecting member, and the activator are in the open position, the aperture in the fluid-flow member may be generally aligned with an aperture in a body of the lid. The aperture in the fluid-flow member and the aperture in the body of the lid may facilitate the flow of fluid into and out of the container.

The fluid pathway may include a flexible portion and the fluid pathway may help provide a passageway for fluid into and/or out of the container. For example, the fluid pathway may be at least partially disposed in and/or aligned with the aperture in the fluid-flow member and the aperture in the body of the lid. The fluid pathway may include a mouthpiece that is intended to allow a user to drink fluid from the container. The fluid pathway and/or the lid may also include a portion that is intended to be connected to a straw and at least a portion of the straw may be disposed in the container. The fluid pathway may then allow fluid to flow through the straw, the opening in the body of the container, the flexible portion of the fluid pathway, and the mouthpiece. The flexible portion may allow the fluid-flow member to move between the open and closed positions. The flexible portion may also allow a portion of the fluid pathway to be closed or pinched off. For example, the connecting member may engage the flexible portion when the connecting member is in the closed position in such a way as to prevent fluid flow through the fluid pathway. In one embodiment, the connecting member may at least partially collapse or pinch the flexible portion to prevent fluid flow when the connecting member is in the closed position. It will be appreciated that fluid flow through the fluid pathway may be prevented by either or both bending the flexible portion, such as by closing the fluid-flow member, and/or pinching a portion of the flexible portion, such as by the connecting member engaging the flexible portion when the connecting member is in the closed position.

When the fluid-flow member is in the open position, the flexible portion of the fluid-flow member may be disposed in a generally linear or straight-line configuration. The flexible portion of the fluid-flow member may be disposed in an angled or bent configuration when the fluid-flow member is in the closed position. In greater detail, when the fluid-flow member, the connecting member, and the activator move between the open and closed positions, the flexible portion of the fluid pathway may bend or straighten. For example, the fluid-flow member may bend the flexible portion of the fluid pathway approximately ninety degrees when the fluid-flow member is in the closed position. The flexible portion of the fluid pathway, however, may be disposed in a generally straight-line when the fluid-flow member is in the open position.

The lid may further include a valve, a pressure release or another opening, which may facilitate drinking from the container. The valve may be disposed in the body of the lid and the valve may be smaller than the opening in the lid. The valve may be a one-way valve designed to decrease or relieve pressure inside the container, which may be created when sucking fluid through the straw. The valve may be disposed towards a center of the lid and proximate the aperture in the body of the lid. The connecting member may include an opening, such as a gap, and the gap may aligned with the valve when the connecting member is in the open position. When the valve and the opening in the connecting member are aligned, that may allow air flow through the valve. On the other hand, in one exemplary embodiment, when the valve and the opening in the connecting member are not aligned, then air or other fluids may not flow through the valve. In another exemplary embodiment, a portion of the fluid pathway may be disposed in the opening in the connecting member and/or aligned with the valve when the lid is closed and this may prevent fluid flow through the valve.

One of ordinary skill in the art, after reviewing this disclosure, will appreciate that the lid and/or the container could include any suitable number of parts and components. In addition, one of ordinary skill in the art, after reviewing this disclosure, will appreciate that the lid and/or the container could have other appropriate shapes, sizes, configurations and arrangements depending, for example, upon the intended use of the lid or container.

These and other aspects, features, and advantages of the present invention will become more fully apparent from the following brief description of the drawings, the drawings, the detailed description of preferred embodiments, and appended claims.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limit its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF THE PREFERRED EMBODIMENTS

The present invention is generally directed towards a lid for a container. The principles of the present invention, however, are not limited to lids for containers. It will be understood that, in light of the present disclosure, the lids and containers disclosed herein may have a variety of shapes, sizes, configurations, and arrangements. It will also be understood that lids and containers may include any suitable number and combination of features, components, aspects, and the like. In addition, while the lids and containers shown in the accompanying figures are illustrated as having particular styles and configurations, it will be appreciated that the lids and containers may have any suitable styles or configurations. Further, the lids and containers disclosed herein may be successfully used in connection with other types of objects and devices.

Additionally, to assist in the description of various exemplary embodiments of the lids and containers, words such as top, bottom, front, rear, right, and left are used to describe the accompanying figures which may be, but are not necessarily, drawn to scale. It will be further appreciated that the disclosed exemplary embodiments of the lids and containers may be disposed in a variety of positions or orientations, and used in numerous locations, environments, and arrangements.

While exemplary embodiments are disclosed and described in detail below, it will be understood that different embodiments may have one or more different parts, components, features and aspects; and the different parts, components, features and aspects may not be required. It will also be understood that different embodiments may include various combinations of these parts, components, features and aspects depending, for example, upon the intended use of the lids and containers.

Figure 1:
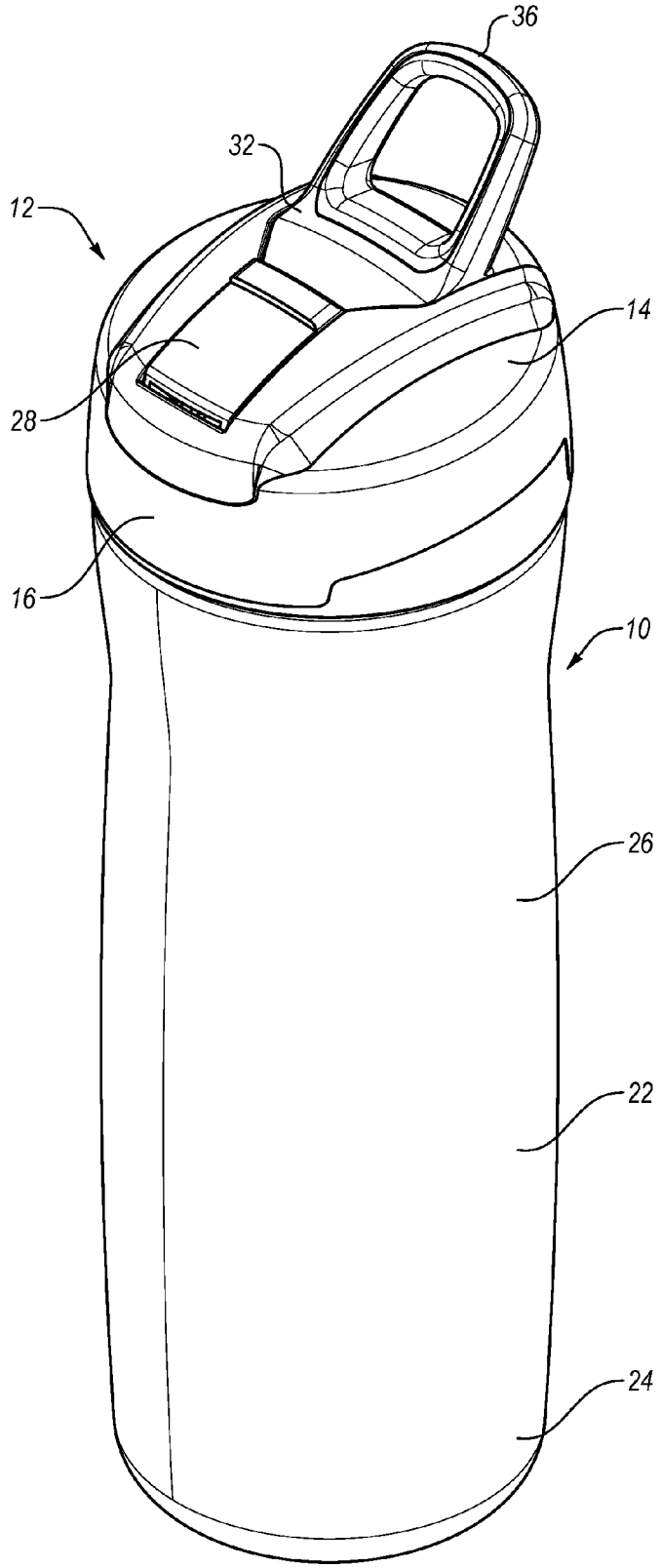
FIG. 1 is a perspective view of an exemplary container and lid, illustrating the lid in a closed position.

As shown in FIG. 1, an exemplary embodiment may include a container 10 and the container may be sized and configured to hold one or more liquids or fluids such as water, flavored water, juices, vitamin-enhanced beverages, energy drinks, thirst-quenchers, soda, and the like. The container 10 can also hold mixtures or solutions such as vitamins, supplements, powdered drinks, electrolyte pills, protein powders, medicinal products, baby formulas, etc. The container 10 could also hold foodstuffs such as fruits, vegetables, soups, dressings, sauces, smoothies, batters, baking materials, and the like. In addition, the container 10 could include non-edible materials such as paints, cleaners, etc. Thus, the container 10 could hold a variety of items, such as liquids, fluids, and/or solids, depending, for example, upon the intended use of the container 10.

Figure 3:
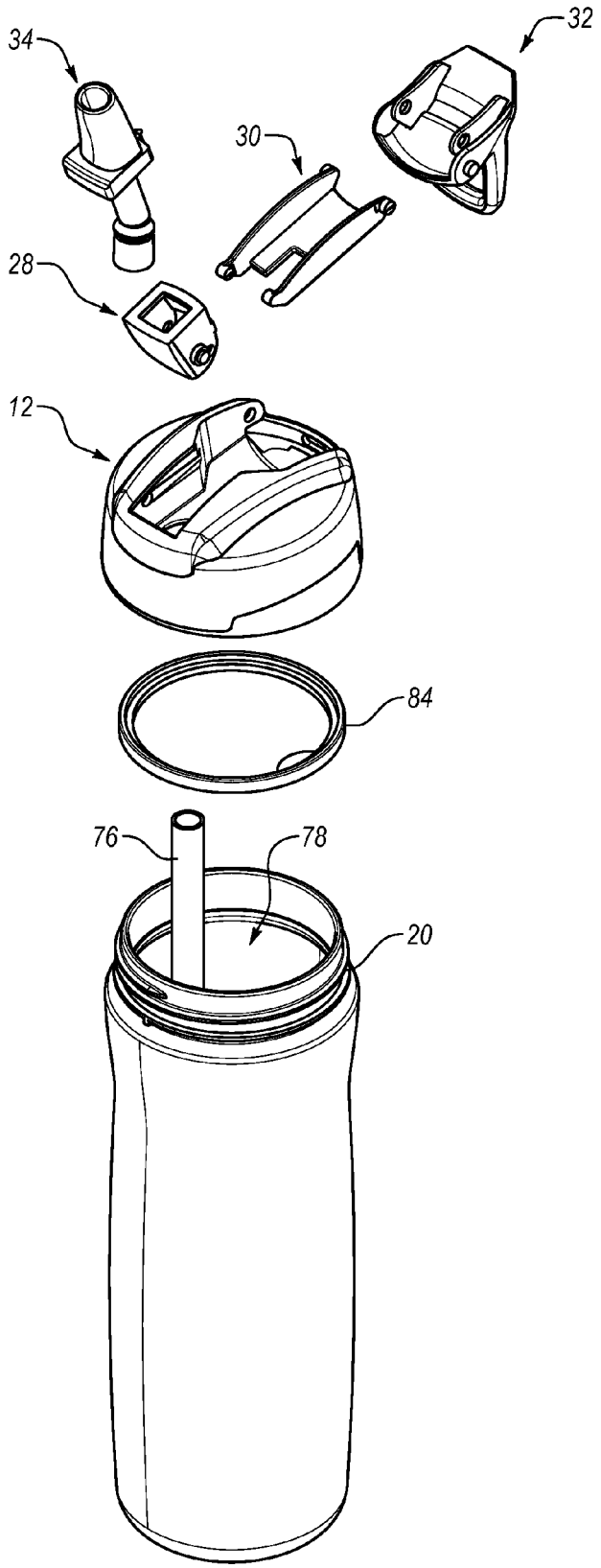
FIG. 3 is an exploded perspective view of the container and lid.

A lid 12 may be attached to the container 10. The lid may include an upper surface 14 and an outer wall or skirt 16. In some embodiments, the lid 12 may be selectively attached to the container 10. For example, the lid 12 may be connected to the container 10 by a threaded connection. In particular, the skirt 16 of the lid 12 may include one or more internal threads and an upper portion 18 of the container may include one or more external threads 20, as illustrated in FIG. 3. The internal threads and external threads 20 may allow the lid 12 to be selectively connected and disconnected from the container 10. It will be appreciated that the lid 12 and the container 10 may be connected in any suitable matter such as a friction fit, interference fit, snap fit, fasteners, clips, and the like. The lid 12 may also be permanently connected to the container 10 and, if desired, the container and lid may be integrally formed as part of a unitary, one-piece structure.

The container 10 may include a body 22 with a base or lower portion 24 and a central portion 26. It will be appreciated by one of ordinary skill in the art, after reviewing this disclosure, that the container 10 may have different shapes, sizes, configurations, arrangements, features and aspects. Exemplary embodiments of containers, and various shapes, sizes, configurations, arrangements, features and aspects, that may be used with the container 10 are shown in U.S. Pat. Nos. D510,235; D677,121; D697,798; D727,097; 8,695,830; and 8,833,586; and U.S. Patent Publication Nos. 2014-0091086 and 2014-0360908; each of which is incorporated by reference in its entirety.

Figure 2:
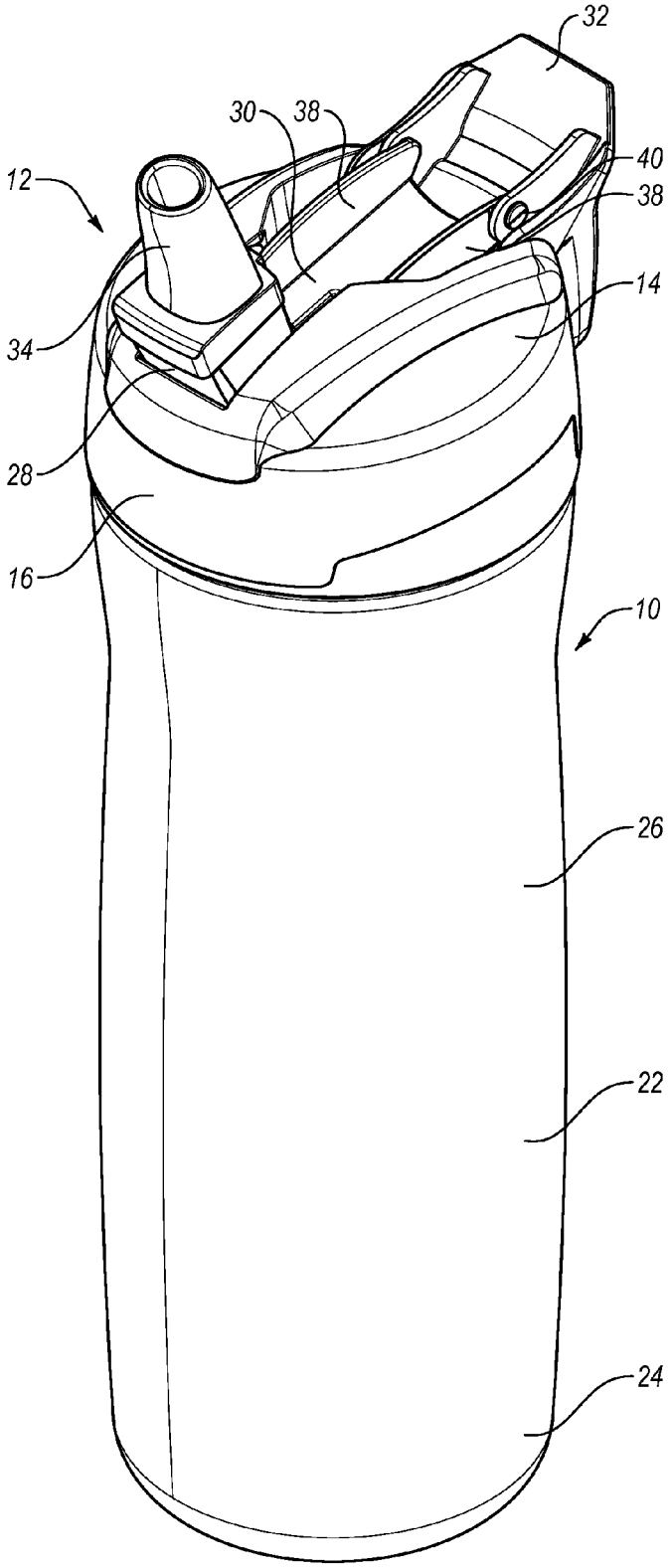
FIG. 2 is another perspective view of the container and lid, illustrating the lid in an open position.

As shown in FIGS. 1 and 2, the lid 12 may include one or more of the following: a fluid-flow member 28, a connecting member 30, and an activator 32. The fluid-flow member 28, the connecting member 30, and/or the activator 32 may be interconnected. The fluid-flow member 28, the connecting member 30, and/or the activator 32 may be movable between open and closed positions. In some embodiments, the fluid-flow member 28, the connecting member 30, and/or the activator 32 may be coupled or linked to simultaneously or dependently move between the open and closed positions. For example, the fluid-flow member 28, the connecting member 30 and/or the activator 32 may be pivotally connected such that the fluid-flow member, the connecting member, and/or the activator may simultaneously move between the open and closed positions.

The lid may also include a fluid pathway 34 that facilitates fluid flow. The fluid pathway 34 may be a structure with a passageway, such as an interior passageway, and fluid may flow through the passageway. The fluid pathway 34 may be an elongated structure with a generally tubular or cylinder-shaped configuration. At least a portion of the fluid pathway 34 may be disposed in the fluid-flow member 28 and movement of the fluid-flow member may move at least a portion of the fluid pathway. A first end of the fluid pathway 34 may form at least a portion of a mouthpiece to facilitate drinking from the container 10 and a second end of the fluid pathway may be connected to or in fluid communication with an opening in the lid 12. The second end of the fluid pathway 34 may also be connected to or in fluid communication with a straw, as discussed in more detail below.

When the fluid-flow member 28, the connecting member 30, and the activator 32 are in the closed position, the container 10 may be in a closed position, as shown in FIG. 1, and fluid may be prevented from exiting the container. When the fluid-flow member 28, the connecting member 30, and the activator 32 are in the open position, the container 10 may be in an open position, as shown in FIG. 2, and fluid may flow through the fluid pathway 34.

The activator 32 may include an extension 36 that extends generally upwardly and/or outwardly from an upper surface of the activator. The extension 36 may form at least a portion of a handle or carrying member, and the carrying member may have a loop-shaped configuration as shown in FIG. 1. The extension 36 may facilitate carrying of the container 10 and the extension may facilitate attaching one or more items to the container and/or the lid 12. The extension 36 may also facilitate moving the activator 32. For example, the extension 36 may help move the activator 32 between the open and closed positions. In particular, a force applied to one side of the extension 36, such as a generally downward force, may move the activator 32 into the open position. A force applied to the other side of the extension 36, such as a generally upward force, may move the activator 32 into a closed position.

Figure 6B:
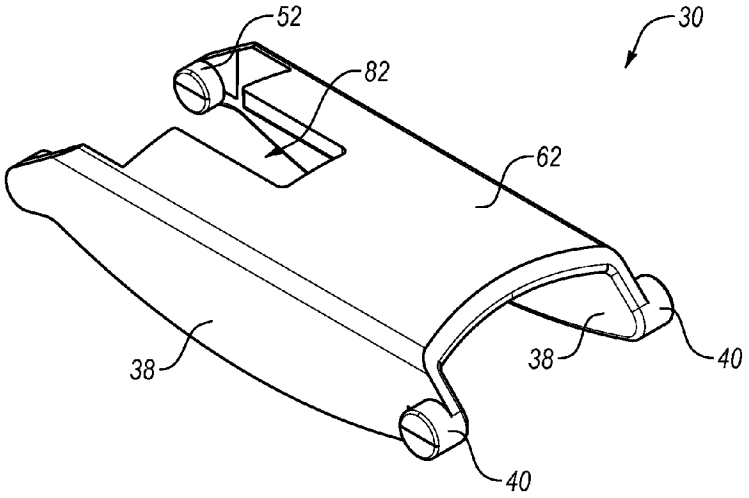
FIG. 6B is a lower perspective view of the connecting member shown in FIG. 6A.
Figure 6A:
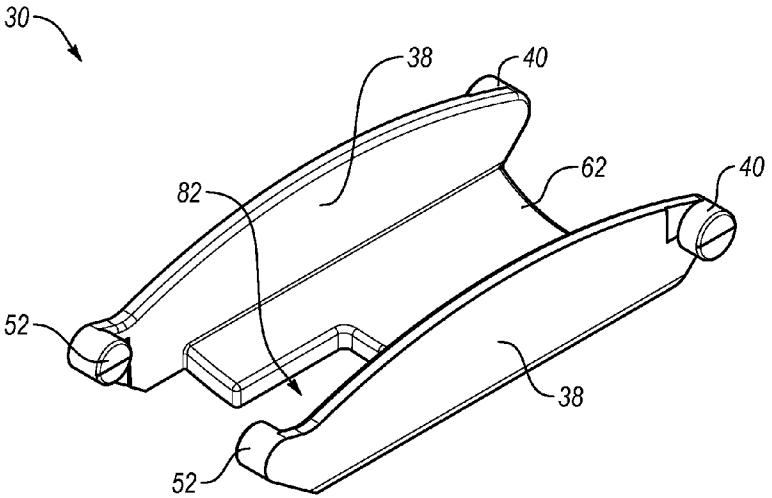
FIG. 6A is an upper perspective view of an exemplary connecting member.
Figure 7B:
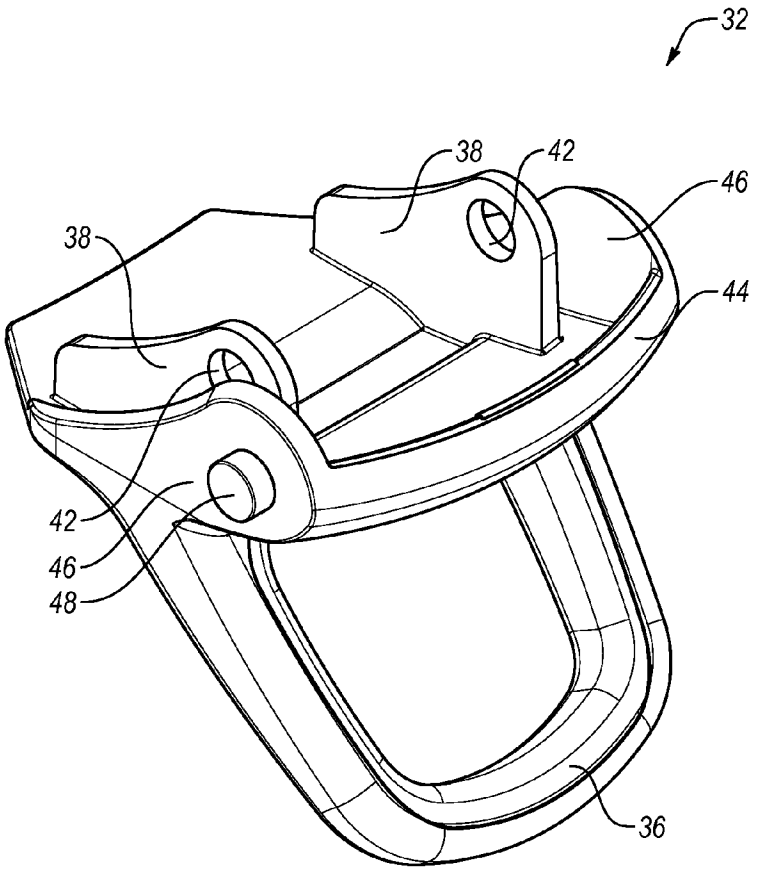
FIG. 7B is a lower perspective view of the activator shown in FIG. 7A.
Figure 7A:
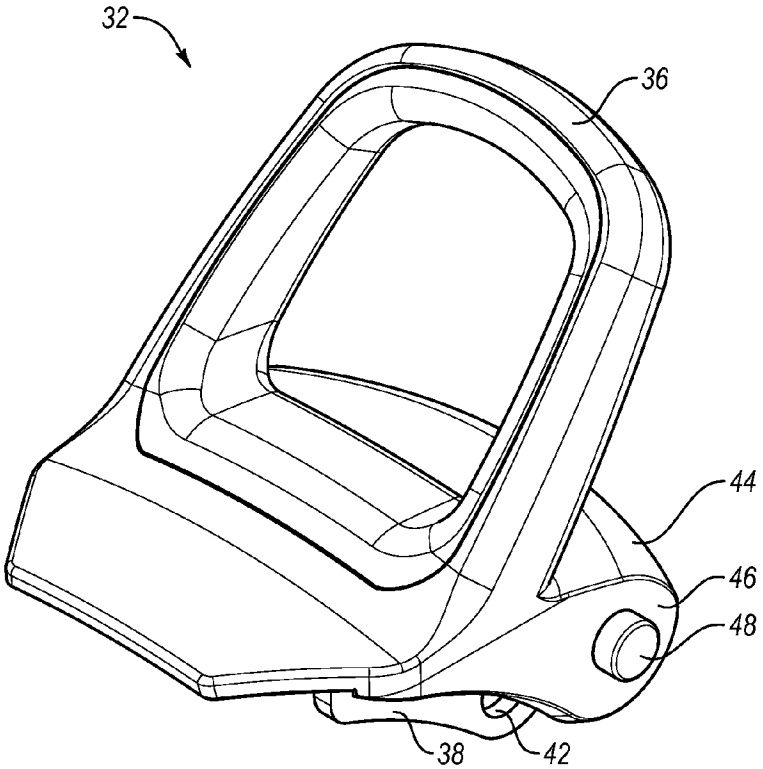
FIG. 7A is an upper perspective view of an exemplary activator.

The activator 32 may be pivotally connected to the connecting member 30. For example, as shown in FIG. 2 and FIGS. 6A-6B, the connecting member 30 may include one or more sidewalls 38 and the activator 32 may be pivotally connected to the sidewalls. In particular, the sidewalls 38 may include one or more protrusions 40 and the protrusions may be inserted into one or more receiving portions 42 of the activator 32 (the receiving portions 42 more clearly shown in FIGS. 7A-7B). One of ordinary skill in the art, after reviewing this disclosure, will appreciate that the activator 32 and the connecting member 30 may be connected in any suitable manner such as a clearance fit, friction fit, interference fit, snap fit, and the like.

Figure 5B:
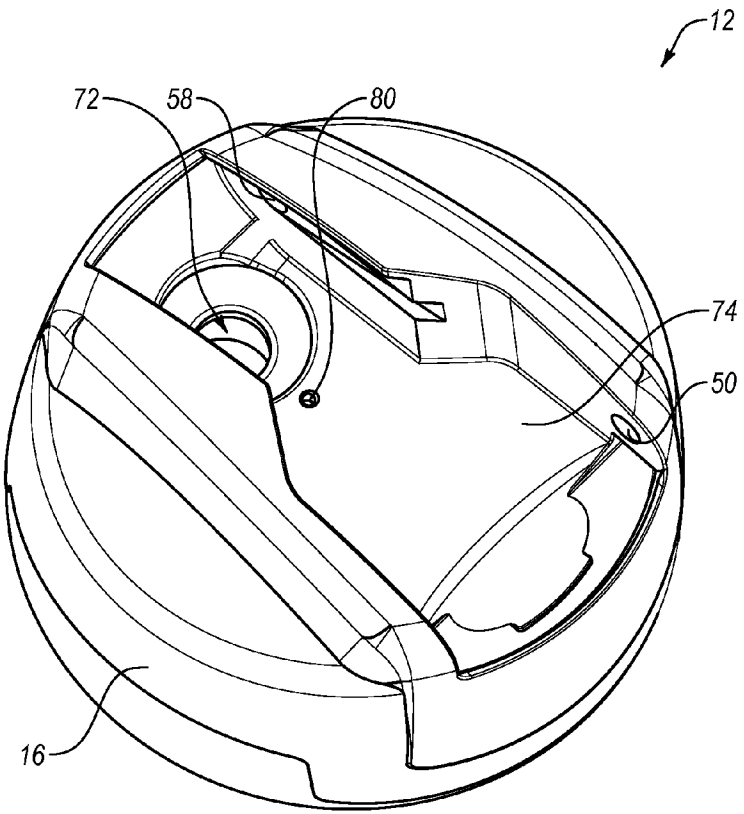
FIG. 5B is another upper perspective view of the portion of the lid shown in FIG. 5A.
Figure 5A:
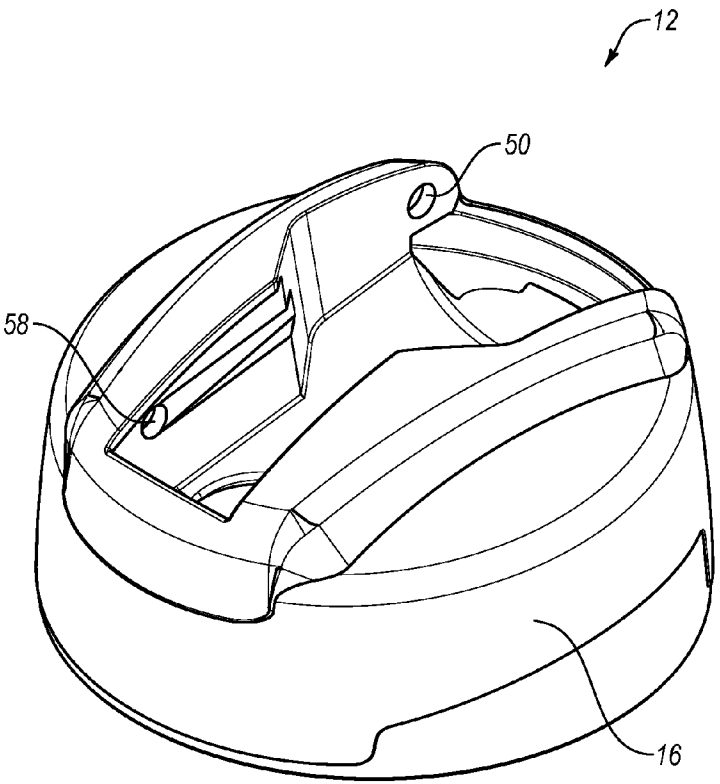
FIG. 5A is an enlarged, upper perspective view of a portion the lid shown in FIG. 1.

The activator 32 may also be pivotally connected to the lid 12. For example, the activator 32 may include an end 44, shown in FIGS. 7A-7B, which may be referred to as the proximal end for convenience, that is sized and configured to be connected to the lid 12. In particular, the activator 32 may include one or more flanges 46 and one or more protrusions 48. The protrusions 48 may be inserted into one or more receiving portions 50 of the lid 12, as shown in FIGS. 5A-5B. One of ordinary skill in the art, after reviewing this disclosure, will appreciate that the activator 32 and the lid 12 may be connected in any suitable manner such as a clearance fit, friction fit, interference fit, snap fit, and the like.

The fluid-flow member 28 may be pivotally connected to the connecting member 30. For example, the fluid-flow member 28 may be pivotally connected to the side walls 38 of the connecting member 30. In particular, as shown in FIG. 2 and FIGS. 6A-6B, the side walls 38 of the connecting member 30 may include one or more protrusions 52 that are inserted into one or more receiving portions 54 of the fluid-flow member 28 (the receiving portions 54 are more clearly shown in FIGS. 8A-8B). In some embodiments, the fluid-flow member 28 may be pivotally connected to an opposite end of the sidewalls 38 as the activator 32. One of ordinary skill in the art, after reviewing this disclosure, will appreciate that the fluid-flow member 28 and the connecting member 30 may be connected in any suitable manner such as a clearance fit, friction fit, interference fit, snap fit, and the like.

The fluid-flow member 28 may be pivotally connected to the lid 12. For example, the fluid-flow member 28 may include one or more protrusions 56, shown in FIGS. 8A-8B, that may be inserted into one or more receiving portions 58 of the lid 12, shown in FIGS. 5A-5B. One of ordinary skill in the art, after reviewing this disclosure, will appreciate that the fluid-flow member 28 and the lid 12 may be connected in any suitable manner such as a clearance fit, friction fit, interference fit, snap fit, and the like.

The fluid-flow member 28, the connecting member 30, and the activator 32 may be interconnected, and the movement of the activator may move the connecting member and the fluid-flow member. For example, movement of the activator 32 from the closed position to the open position may cause the connecting member 30 and the fluid-flow member 28 to move from the closed positions to the open positions. Similarly, movement of the activator 32 from the open position to the closed position may move the connecting member 30 and the fluid-flow member 28 from the open positions to the closed positions.

In greater detail, the protrusions 40 of the connecting member 30 and the receiving portions 42 of the activator 32 may form a pivotal connection. The protrusions 48 of the activator 32 and the receiving portions 50 of the lid 12 may form another pivotal connection. Thus, the activator 32 may be pivotally connected to both the lid 12 and the connecting member 30.

The protrusions 52 of the connecting member 30 and the receiving portions 54 of the fluid-flow member 28 may form still another pivotal connection. The protrusions 56 of the fluid-flow member 28 and the receiving portions 58 of the lid 12 may form a further pivotal connection. Therefore, the fluid-flow member 28 may be pivotally connected to both the lid 12 and the connecting member 30. In this exemplary embodiment, the activator 32 may be pivotally connected to the lid 12 by a first pivotal connection; the activator may be pivotally connected to the connecting member 30 by a second pivotal connection; the fluid-flow member 28 may be pivotally connected to the lid by a third pivotal connection; and the fluid-flow member may be pivotally connected to the connecting member. Accordingly, the lid 12, the activator 32, the connecting member 30, and the fluid-flow member 28 may be connected at four pivot points. When the activator 32, the connecting member 30, and the fluid-flow member 28 are in the closed position, the positioning or geometry of the four pivot points may provide an over-center latch, linkage or mechanism that creates a pressure or a force between the activator and the fluid-flow member that helps keep or maintain the lid 12 in the closed position. In this exemplary configuration, the activator 32 must be acted upon to move to the open position. An exemplary over-center latching assembly is shown in U.S. Pat. No. 8,844,746, which is included by reference in its entirety.

As mentioned above, the fluid-flow member 28, the connecting member 30, and the activator 32 may be moved between the open and closed positions by applying a force to the activator. In particular, a user may apply a force to the extension 36 of the activator 32 to move the fluid-flow member 28, the connecting member 30, and the activator 32 between the open and closed positions. In further detail, the user may apply an opening force to a first portion of the extension 36 to move the activator 32 from the closed position to the open position. The user may also apply a closing force to a second portion of the extension 36 to move the activator 32 from the open position to the closed position.

Significantly, the user may only touch the extension 36 of the activator 32 to open and close the lid 12 and/or control fluid flow to allow a user to drink fluid from the container 10. Because the user may only touch the extension 36 to open and close the lid 12, that may facilitate use of the lid when a user's hands may be unclean or unwashed, the user is wearing gloves, the user's hands are sweaty or perspiring, and the like. Importantly, this may facilitate use of the lid 12 in environments such as exercising, bodybuilding, climbing, gardening, construction, repairing, cleaning, wearing gloves, and the like where it may be desirable not to touch any surfaces that may touch the user's mouth.

When the activator 32 is in the closed position, the extension 36 may be disposed in a generally upward direction. When the activator 32 is in the open position, the extension 36 may be disposed in a generally downward direction and/or may contact a portion of the lid 12 such as the upper surface 14 of the lid and/or an outer edge of the skirt 16 of the lid 12.

Figure 8B:
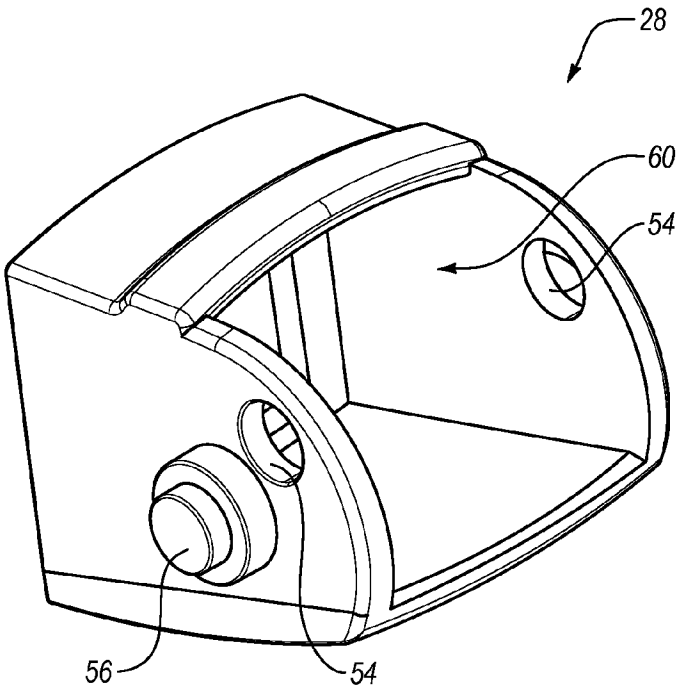
FIG. 8B is a lower perspective view of the fluid-flow member shown in FIG. 8A.
Figure 8A:
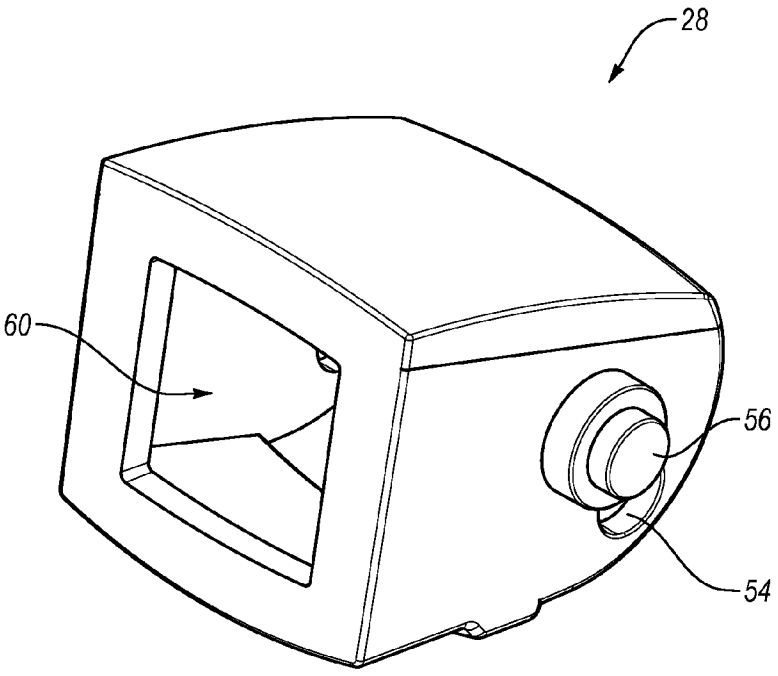
FIG. 8A is an upper perspective view of an exemplary fluid-flow member.

As shown in FIGS. 8A-8B, the fluid-flow member 28 may include an aperture 60 and a portion of the fluid pathway 34 may be disposed in the aperture. When the fluid-flow member 28 is in the closed position, the aperture 60 may be disposed generally parallel to and aligned with a length of the body 62 of the connecting member 30. Also, when the fluid-flow member 28 is in the closed position, at least a portion of the fluid-flow member may be disposed between the sidewalls 38 of the connecting member 30 and/or may contact an upper surface of the body 62 of the connecting member 30.

When the fluid-flow member 28 is in the closed position, a portion of the fluid pathway 34 may be disposed generally parallel to the body 62 of the connecting member 30. In greater detail, an end or upper portion 64 of the fluid pathway 34, such as a mouthpiece, may be disposed generally parallel to the upper surface 14 of the lid 12 and at least a portion of the mouthpiece may be disposed beneath a portion of the activator 32 when the lid is closed. This may help protect the mouthpiece 64 from damage and/or from becoming dirty or contaminated.

Figure 4B:
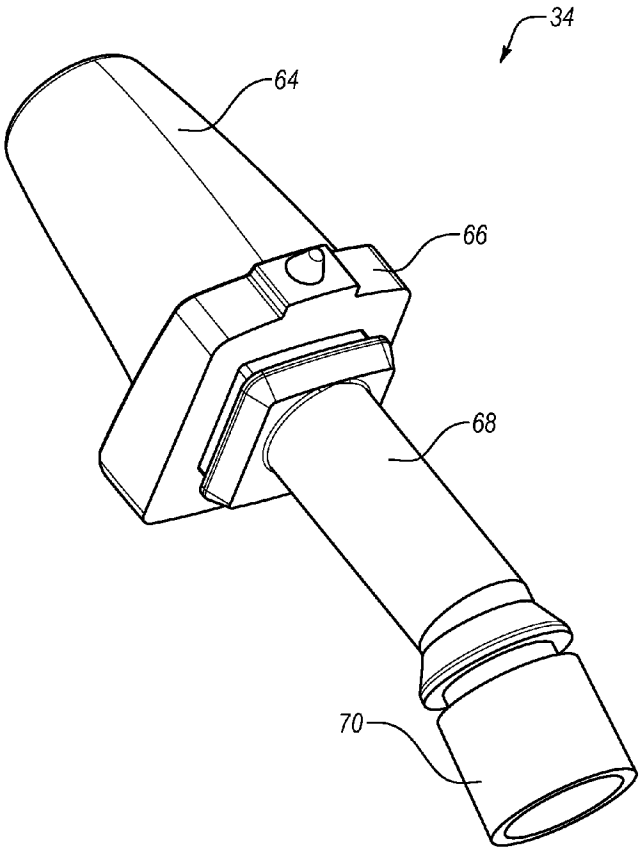
FIG. 4B is a rear perspective view of the straw connector shown in FIG. 4A.
Figure 4A:
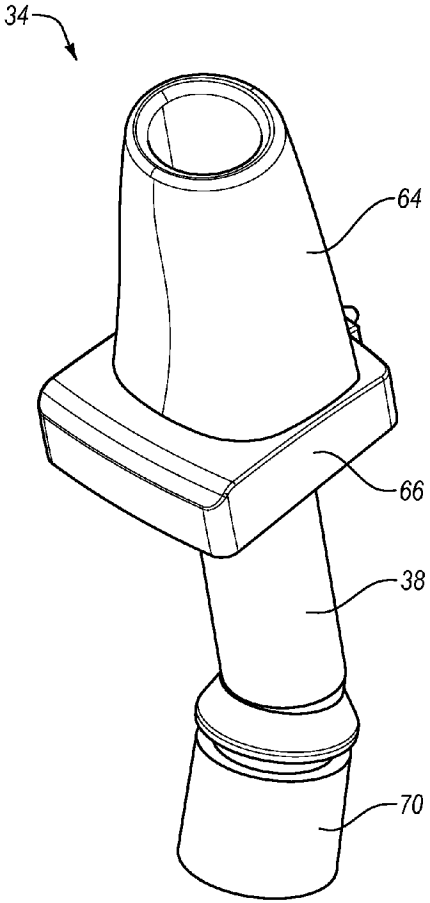
FIG. 4A is an upper perspective view of an exemplary straw connector.

As shown in FIGS. 4A-4B, the fluid pathway 34 may include the upper end 64, a positioning member 66, a flexible portion 68, and a lower end 70. The user may suck on the upper end or mouthpiece 64 in order to drink fluid from the container 10. The positioning member 66 may be sized and configured to help position and/or connect the fluid pathway 34 to the fluid-flow member 28, such as, for example, by a friction or interference fit. The flexible portion 68 may be constructed from any suitable flexible material, such as plastic, rubber, and the like. A fluid passageway, which may be as an interior passageway or hollow interior portion, may be disposed in the upper end 64, the position member 66, the flexible portion 68 and the lower end 70, and the fluid passageway may allow fluid to flow through the fluid pathway 34. As shown in the accompanying figures, the upper end 64, the flexible portion 68, and the lower end 70 may have a generally cylindrical or tubular-shaped configuration. One of ordinary skill in the art will understand, after reading this disclosure, that the fluid pathway 34 may other suitable shapes, sizes, configurations, and arrangements.

The lower end 70 of the fluid pathway 34 may be coupled, connected, aligned and/or in fluid communication with an aperture 72 in the body 74 of the lid 12, shown in FIGS. 5A-5B. For example, the lower end 70 of the fluid pathway 34 may be at least partially disposed in the aperture 72. The lower end 70 of the fluid pathway 34 may be connected to the lid, if desired, in any suitable manner such as a friction fit, interference fit, snap fit, fasteners, clips, and the like. In greater detail, the lower end 70 of the fluid pathway 34 may be sized and configured to fit within the aperture 72 such that the lower end may be coupled to the aperture by a friction or interference fit, which may prevent fluid from leaking out of the container 10 through the aperture.

In some embodiments, a straw 76 may be at least partially disposed in the container 10 and the straw may be coupled to the lower end 70 of the fluid pathway 34 and/or the aperture 72 in the lid 12 in any suitable manner such as a friction fit, interference fit, snap fit, fasteners, clips, and the like. For example, a diameter of the straw 76 may be larger or smaller than a diameter of the lower end 70 of the fluid pathway 34 and/or the aperture 72 in the lid, and that may allow the straw to be connected to the fluid pathway or aperture by a friction or interference fit. The straw 76 and the fluid pathway 34 may provide a fluid passageway that may allow fluid to flow from the container 10, through the fluid pathway, and to the mouthpiece 64.

When the fluid-flow member 28 is in the open position, the aperture 60 in the fluid-flow member may be generally aligned with the aperture 72 in the lid 12 and the flexible portion 68 of the fluid pathway 34 may be disposed in a generally straight or linear configuration. This configuration may allow fluid to flow from the container 10 through the fluid pathway 34. On the other hand, when the fluid-flow member 28 is in the closed position, the aperture 60 in the fluid-flow member may be not aligned with the aperture 72 in the lid 12 and the flexible portion 68 of the fluid pathway 34 may be disposed in an angled position of at least 60°, 70°, 80°, 90° or more. In this configuration, the flexible portion 68 of the fluid pathway 34 may be angled or bent to pinch or close the fluid passageway, which may prevent fluid flow through the fluid passageway.

In greater detail, when the connecting member 30 and the activator 32 move between the open and closed positions, the flexible portion 68 of the fluid pathway 34 may be configured to bend and/or straighten. For instance, when the fluid-flow member 28, the connecting member 30, and the activator 32 move from the open position to the closed position, the flexible portion 68 of the fluid pathway 34 may be at an angle, such as, for example, approximately 60°, 70°, 80°, 90°, or more. Alternatively, when the fluid-flow member 28, the connect member 30, and the activator 32 move from the closed position to the open position, the flexible portion 68 of the fluid pathway 34 may be at least substantially straightened so that the flexible portion is bent at no more than an angle of about 30°, 20°, 10°, or less.

When the fluid-flow member 28, the connecting member 30, and the activator 32 are in the closed position, the connecting member may be configured to pinch or otherwise close a portion of the flexible portion 68 to prevent the fluid from flowing through the flexible portion of the fluid pathway 34. When the fluid-flow member 28, the connecting member 30, and the activator 32 are in the open position, the connecting member may not pinch or close the flexible portion 68 and this may allow fluid to flow through the fluid pathway 34.

In some embodiments, the bending of the flexible portion 68 of the fluid pathway 34 may prevent fluid flow through the fluid pathway. In other embodiments, the connecting member 30 may pinch or close a portion of the fluid pathway 34 to prevent fluid flow through the fluid pathway. If desired, the bending of the flexible portion 68 of the fluid pathway 34 and/or the movement of the connecting member 30 may independently and/or in combination close a portion of the fluid pathway 34 to prevent fluid flow through the fluid pathway.

In some embodiments, the lid 12 may include an opening 80, as shown in FIG. 5B. The opening 80 may be located in the body 74 of the lid and the opening may be smaller than the aperture 72. The opening 80 may be sized and configured to allow air to enter or exit the container 10. For example, the opening 80 may be designed to decrease or relieve pressure that can be created when drinking from the container 10. The opening 80 may include a valve, such as a one-way valve, or other suitable structure, if desired.

As shown in FIGS. 6A-6B, the connecting member 30 may include an opening 82, such as a gap. The opening 82 may be disposed, for example, in the body 62 of the connecting member 30. When the fluid-flow member 28, the connecting member 30, and the activator 32 are in the open position, the opening 82 may be disposed directly above and/or generally aligned with the valve 80, which may allow air to flow through the valve. When the fluid-flow member 28, the connecting member 30 and the activator 32 are in the closed position, the opening 82 may not be aligned with the valve 80 and this may prevent fluid flow through the valve. In some embodiments, a portion of the fluid pathway 34, such as a protrusion or projection, may at least partially cover and/or be disposed in the valve 80 and/or opening 82 when the fluid-flow member 28, the connecting member 30 and the activator 32 are in the closed position, which may prevent fluid flow through the valve.

Figure 9B:
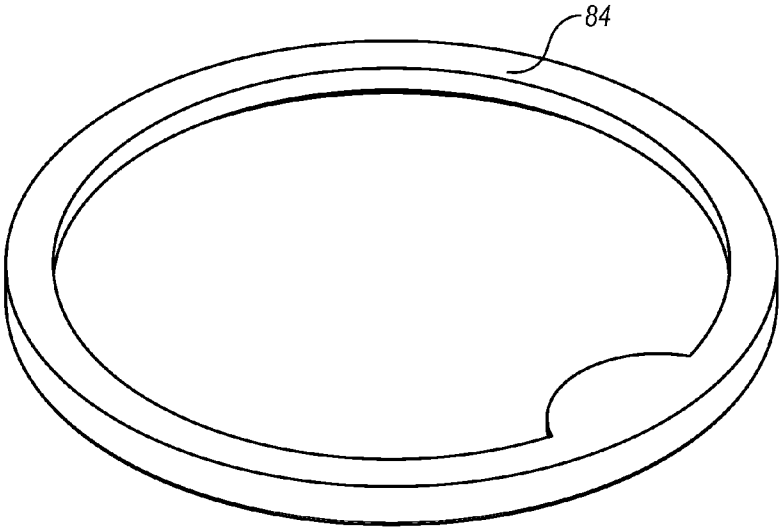
FIG. 9B is a lower perspective view of the lid gasket shown in FIG. 9A.
Figure 9A:
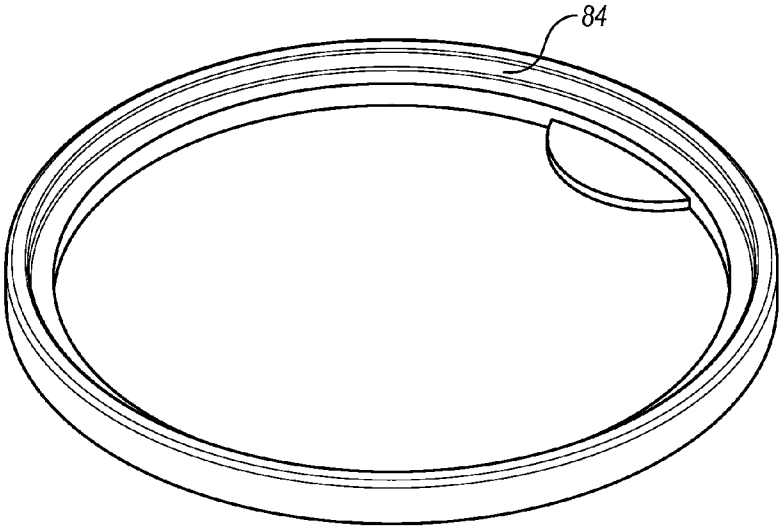
FIG. 9A is an upper perspective view of an exemplary lid gasket.

In some embodiments, the container 10 may include a gasket 84, which may help create a fluid-tight seal between the lid 12 and the body 22 of the container 10. An exemplary gasket 84 is shown in FIGS. 9A and 9B.

In some embodiments, a locking mechanism may be used to lock at least a portion of the lid 12 in the closed position. For example, the locking mechanism may including a locking member 86 and the locking member 86 may lock the activator 32, the connecting member 30 and/or the fluid-flow member 28 in the closed position. The locking member 86 may have to be released or unlocked before the activator 32, the connecting member 30 and/or the fluid-flow member 28 can be moved from the closed to the open position.

Figure 10A:
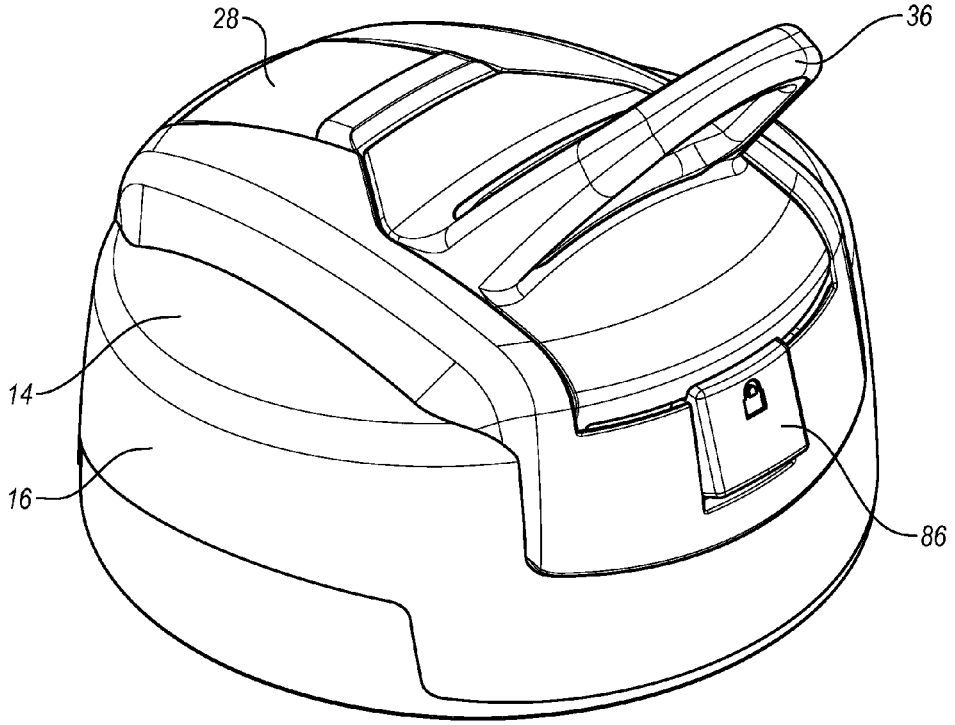
FIG. 10A is an upper perspective view of another exemplary lid, illustrating the lid in a closed position and an exemplary locking member in a locked position.
Figure 10B:
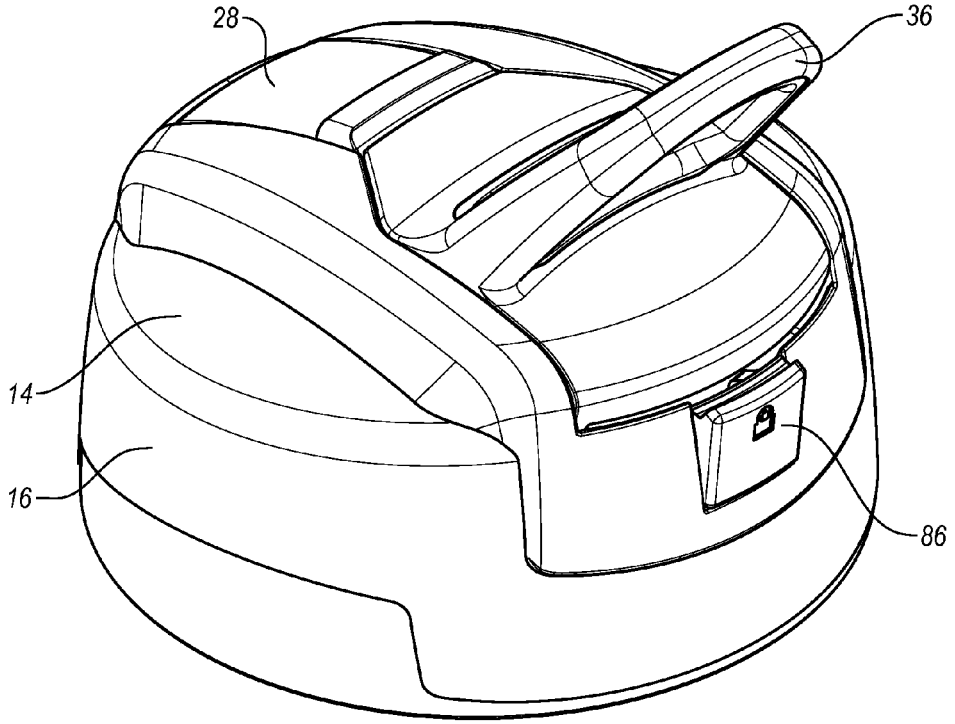
FIG. 10B is an upper perspective view of the lid shown in FIG. 10A, illustrating the lid in the closed position and the locking member in an unlocked position.
Figure 10C:
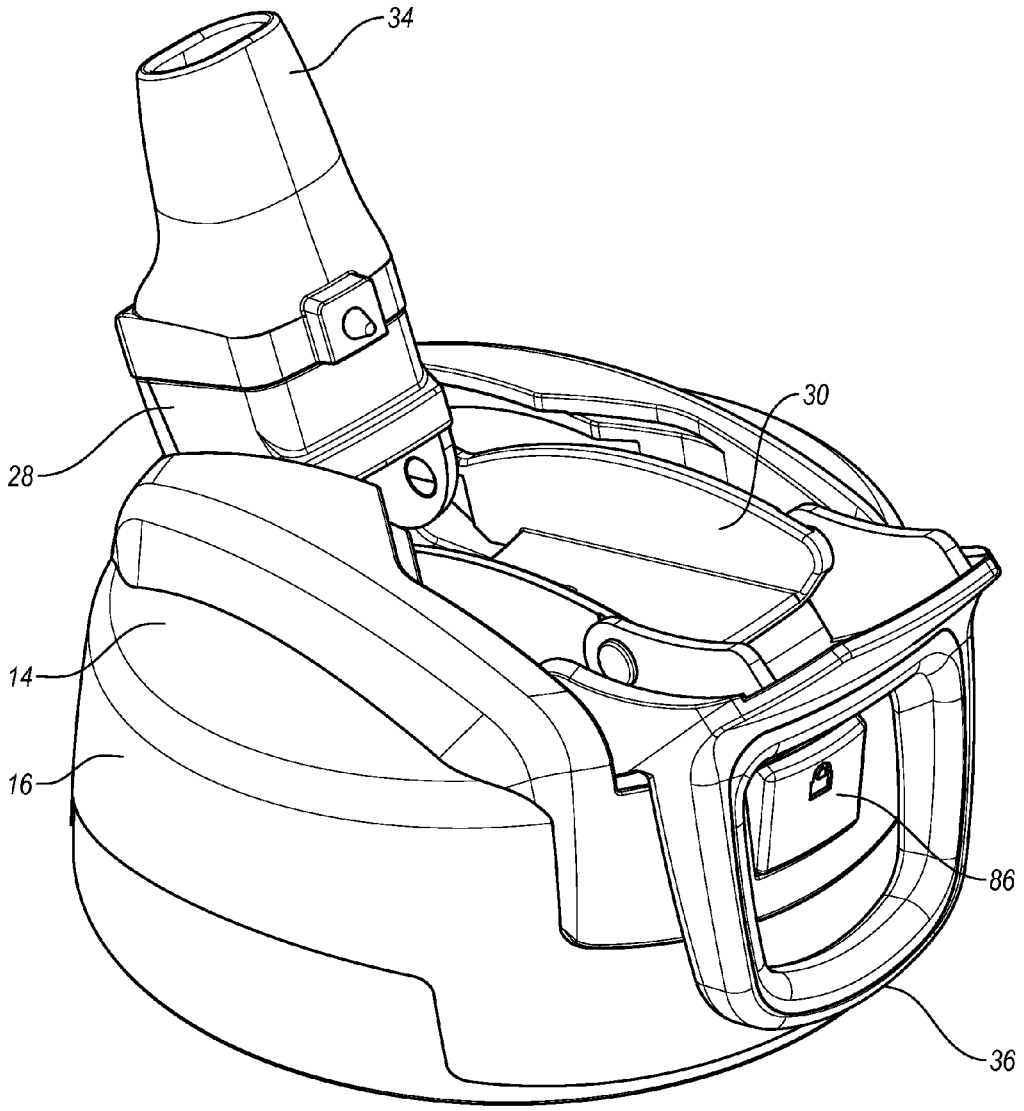
FIG. 10C is an upper perspective view of the lid shown in FIG. 10A, illustrating the lid in an open position and the locking member in the unlocked position.

In greater detail, as shown in FIGS. 10A, 10B, and 10C, the locking member 86 may be disposed on a rear portion of the lid 12. For example, the locking member 86 may be connected to the outer wall or skirt 16 and the locking member may be movable between a locked position, such as shown in FIG. 10A, and an unlocked position, such as shown in FIGS. 10B and 10C. In one exemplary embodiment, a lower portion of the locking member 86 may be pivotally connected to the skirt 16 and an upper portion of the locking member may include an engaging portion that engages a portion of the activator 32 when the locking member is in the locked position. For instance, the locking member 86 may include a receiving portion and at least a portion of the activator 32 may be disclosed in the receiving portion when the locking member is in the locked position. Alternatively, the activator 32 may include a receiving portion and at least a portion of the locking member 86 may be disposed in the receiving portion when the locking member is in the locked position. One of ordinary skill in the art, after reviewing this disclosure, will appreciate that the locking mechanism and locking member 86 may have other shapes, sizes, configurations, and arrangements depending, for example, upon the intended use of the lid 12. It will also be appreciated that the locking mechanism or locking member 86 is not required.

When it is desired to open the lid 12, a force may be applied to the extension 36. In particular, a generally downward and/or rearward force may be applied to a first portion of the extension 36 and that may cause the activator 32 to move from a closed position to an open position. The movement of the activator 32 may cause the connecting member 30 and/or the fluid-flow member 28 to move from closed to open positions. Advantageously, a user may drink from the container 10 when the lid 12 is in the open position. When it is desired to close the lid 12, a generally upward and/or forward force on a second portion of the extension 36 may cause the activator 32 to move from the open position to the closed position. The movement of the activator 32 from the open to the closed position may cause the connecting member 30 and/or the fluid-flow member 28 to move from open to closed positions. When the fluid-flow member 28 is in the closed position, the activator 32 may cover at least a portion of the flow-flow member such as a mouthpiece. Thus, the activator 32 may help protect the mouthpiece from damage, dirt, and the like when the flow-flow member 28 and activator 32 are in the closed position.

In an embodiment with a locking mechanism, the locking member 86 may be used to maintain and/or secure the lid 12 in the closed position. In this exemplary embodiment, when it is desired to open the lid 12, a force may be applied to the locking member 86 and the locking member may move from the locked to the unlocked position. When the locking member 86 is unlocked, the activator 32 may be moved from the closed to the open position and this movement may cause the connecting member 30 and/or the fluid-flow member 28 to move from the closed to open positions. If desired, the locking member 86 may be used to maintain and/or secure the lid 12 in the open position. When the activator 32 is moved into the closed position, the locking member 86 preferably automatically locks the activator in the closed position. The locking member 86 may be automatically and/or manually locked and/or unlocked depending, for example, upon the intended use of the container 10 and/or lid 12.

After reviewing this disclosure, one of ordinary skill in the art will understand that the fluid-flow member 28, the connecting member 30, the activator 32, and the fluid pathway 34 may have other suitable shapes, shapes, configurations and arrangements depending, for example, upon the size and shape of the container 10 and/or the lid 12.

The container 10 and the lid 12 may be constructed from durable, long-lasting materials. The container 10 and the lid 12 may also be constructed from materials that may be reused and/or recycled. The container 10 and the lid 12 may, for example, be constructed from a relatively rigid, durable, and high-strength materials such as plastic, polymers, and composites. In particular, the container 10 and the lid 12 may be constructed from materials such as polyethylene, copolyester, or other materials with similar properties and/or characteristics. In view of this disclosure, one of ordinary skill in the art will appreciate that the container 10 and the lid 12 may be constructed from various materials with desired properties such as different types of plastics, glass, metal, composites, and the like. Additionally, the container 10 and the lid 12 may be constructed from at least partially transparent or translucent materials, which may allow the user to see the type and/or amount of fluids in the container.

Advantageously, the lid 12 may be simple to use and operate. In addition, the lid 12 may be quickly and easily assembled, cleaned, and disassembled. Further, the lid 12 may be efficiently manufactured, easily repaired, and/or conveniently replaced.

The present invention may be embodied in other specific forms without departing from its spirit or essential characteristics. The described embodiments are to be considered in all respects as only illustrative and not restrictive. The scope of the invention is, therefore, indicated by the appended claims, rather than by the foregoing description. All changes which come within the meaning and range of equivalency of the claims are to be embraced within their scope.

The invention claimed is:

1. A lid sized and configured to be attached to a container, the container sized and configured to be filled with one or more fluids, the lid comprising:

a body;

an activator pivotally coupled to the body of the lid;

a fluid-flow member pivotally coupled to the body of the lid; and a connecting member pivotally coupled to the fluid-flow member and the activator;

wherein the activator, the connecting member, and the fluid-flow member are interconnected such that movement of the activator moves the connecting member and the fluid-flow member;

wherein the activator, the connecting member, and the fluid-flow member are each movable between a first position and a second position;

wherein when the activator, the connecting member, and the fluid-flow member are in the first position, fluid is prevented from exiting the container through the fluid-flow member; and wherein when the activator, the connecting member, and the fluid-flow member are in the second position, the fluid may exit the container through the fluid-flow member.

2. The lid as in claim 1, further comprising a fluid pathway, the fluid pathway at least partially disposed in the fluid-flow member, the fluid pathway forming at least a portion of a fluid passageway that allows fluid to flow from the container when the activator, the connecting member, and the fluid-flow member are in the second position.

3. The lid as in claim 2, wherein the connecting member is configured to pinch the fluid pathway to prevent fluid flow through the fluid pathway when the activator, the connecting member, and the fluid-flow member are in the first position.

4. The lid as in claim 2, wherein when the fluid-flow member, the connecting member, and the activator are disposed in the first position, a portion of the fluid pathway is bent at least approximately ninety degrees.

5. The lid as in claim 1, wherein the activator at least partially encloses an upper end of the flow-flow member when the activator and fluid-flow member are in the first position.

6. The lid as in claim 1, wherein the connecting member further comprises:

an elongated body;

a first sidewall disposed along a first side of the elongated body; and a second sidewall disposed along a second side of the elongated body;

wherein at least a portion of the fluid-flow member is disposed between the first sidewall and the second sidewall of the elongated body of the connecting member when the activator, the connecting member, and the fluid-flow member are in the first position.

7. The lid as in claim 2, wherein the connecting member further comprises:

an elongated body;

a first sidewall disposed along a first side of the elongated body; and a second sidewall disposed along a second side of the elongated body;

wherein at least a portion of the fluid pathway is disposed between the first sidewall and the second sidewall of the elongated body of the connecting member when the activator, the connecting member, and the fluid-flow member are in the first position.

8. The lid as in claim 1, wherein the activator is pivotally connected to a first side of the body of the lid, the fluid-flow member is pivotally connected to an opposing second side of the body of the lid, and the connecting member is at least substantially disposed between the pivotal connection of the activator to the first side of the lid and the pivotal connection of the fluid-flow member to the second side of the lid.

9. The lid as in claim 1, wherein the activator is pivotally connected to the body of the lid at a first pivotal connection, the connecting member is pivotally connected to the activator at a second pivotal connection, the fluid-flow member is pivotally connected to the body of the lid at a third pivotal connection, and the connecting member is pivotally connected to the fluid-flow member at a fourth pivotal connection.

10. The lid as in claim 9, wherein the first pivotal connection and the third pivotal connection are disposed in a fixed location relative to the lid; and wherein the second pivotal connection and the fourth pivotal connection are disposed in a non-fixed location relative to the lid.

11. The lid as in claim 1, further comprising a fluid pathway including a flexible portion that prevents fluid flow through the fluid pathway when the activator, the connecting member, and the fluid-flow member are in the first position, the flexible portion allows fluid flow through the fluid pathway when the activator, the connecting member, and the fluid-flow member are in the second position.

12. The lid as in claim 1, further comprising:

a body of the lid that covers at least a portion of a mouth of the container;

a first opening in the body that provides a fluid passageway to the fluid pathway;

a second opening in the body that allows air to enter the container; and a gap in the connecting member;

wherein when the fluid-flow member, the connecting member, and the activator are in the second position, the gap is disposed directly above the second opening in the body to allow air to enter the container; and wherein when the fluid-flow member, the connecting member, and the activator are in the first position, the gap is not aligned with the second opening in the body.

13. The lid as in claim 1, further comprising a locking mechanism the locks the activator, the connecting member, and the fluid-flow member in the first position.

14. A lid sized and configured to be attached to a container, the container sized and configured to be filled with one or more fluids, the lid comprising:

a body, an activator connected to the body, the activator movable between an open position and a closed position;

a fluid-flow member connected to the body;

a connecting member connected to the activator and the fluid-flow member; and a fluid pathway that allows fluid to flow from the container;

wherein movement of the activator from the closed position to the open position moves the fluid-flow member from a closed position to an open position;

wherein movement of the activator from the open position to the closed position moves the fluid-flow member from the open position to the closed position;

wherein fluid flow through the fluid pathway is prevented when the fluid-flow member is in the closed position; and wherein fluid flow through the fluid pathway is permitted when the fluid-flow member is in the open position.

15. The lid as in claim 14, wherein in response to movement of the activator from the open position to the closed position, the connecting member prevents fluid flow through the fluid pathway.

16. The lid as in claim 14, wherein in response to movement of the activator from the open position to the closed position, the fluid-flow member bends a portion of the fluid pathway to prevent fluid flow through the fluid pathway.

17. The lid as in claim 14, wherein the fluid-flow member bends the fluid pathway approximately ninety degrees to prevent fluid flow through the fluid pathway.

18. The lid as in claim 14, wherein at least a portion of the fluid-flow member is disposed at least adjacent to the connecting member when the activator, the connecting member, and the fluid-flow member are in the first position.

19. The lid as in claim 14, wherein the activator is pivotally connected to a first side of the body of the lid, the fluid-flow member is pivotally connected to an opposing second side of the body of the lid, and the connecting member is at least substantially disposed between the pivotal connection of the activator to the first side of the lid and the pivotal connection of the fluid-flow member to the second side of the lid when the activator and the fluid-flow member are in the second position.

20. The lid as in claim 14, wherein the activator is pivotally connected to the body of the lid at a first pivotal connection, the connecting member is pivotally connected to the activator at a second pivotal connection, the fluid-flow member is pivotally connected to the body of the lid at a third pivotal connection, and the connecting member is pivotally connected to the fluid-flow member at a fourth pivotal connection.

21. The lid as in claim 20, wherein the first pivotal connection and the third pivotal connection are disposed in a fixed location relative to the lid; and wherein the second pivotal connection and the fourth pivotal connection are disposed in a non-fixed location relative to the lid.

22. The lid as in claim 14, further comprising a locking mechanism connected to the body, the locking member movable between a locked position in which the activator is locked in position and an unlocked position in which the activator is movable between the locked position and an unlocked position.

* * * * *